US005370407A

United States Patent [19]

Whalen

[11] Patent Number: 5,370,407

[45] Date of Patent: Dec. 6, 1994

[54] SKATE BATON APPARATUS

[76] Inventor: David P. Whalen, Smith Beach Rd. 18A, Oswego, N.Y. 13126

[21] Appl. No.: 38,823

[22] Filed: Mar. 29, 1993

[51] Int. Cl.[5] ..... A63C 3/00

[52] U.S. Cl. ..... 280/809; 280/11.19; 280/823; 135/75; 135/77

[58] Field of Search ..... 280/809, 819, 823, 826, 280/11.19; 135/77, 78, 82, 86, 75, 69

[56] References Cited

U.S. PATENT DOCUMENTS

| | | | |
|---|---|---|---|
| D. 262,646 | 1/1982 | Mace | 280/809 |
| 3,825,275 | 7/1974 | Klemm | 280/823 |
| 5,163,710 | 11/1972 | Chirtel et al. | 280/809 |

*Primary Examiner*—Richard M. Camby
*Attorney, Agent, or Firm*—E. Michael Combs

[57] ABSTRACT

A baton structure having first and second cylindrical housings arranged for securement relative to one another are provided, wherein each of the first and second housings include housing tubes and rods arranged for telescoping extension and locking relative to each of the housings, with each of the rods having a resilient tip for use as a friction tip to promote displacement along a skating surface by an individual. The first housing includes a reflective mirror structure for viewing traffic conditions rearwardly of an individual, with the second housing having a fluid dispenser to dispense a defensive fluid such as (MACE) therefrom.

5 Claims, 4 Drawing Sheets

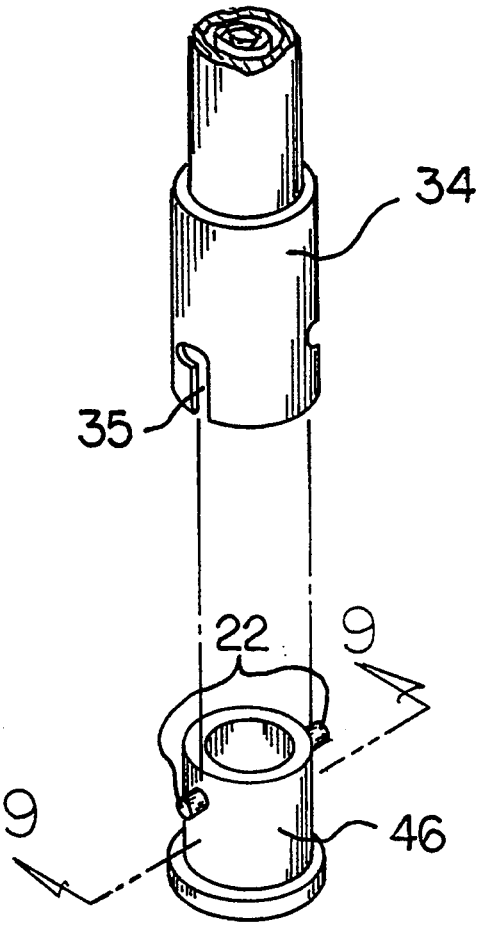
FIG 8
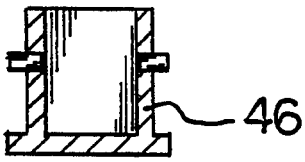
FIG 9
FIG 10
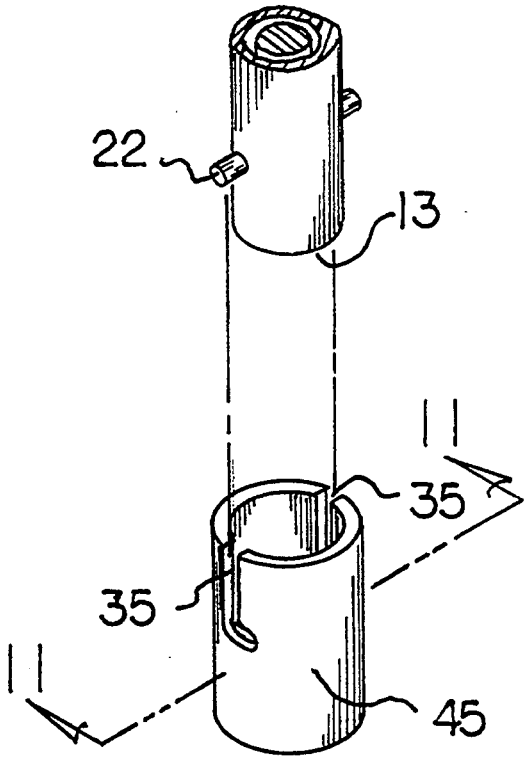
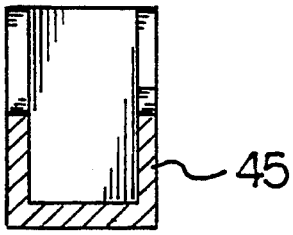
FIG 11

SKATE BATON APPARATUS

BACKGROUND Of THE INVENTION

1. Field of the Invention

The field of invention relates to pole structure, and more particularly pertains to a new and improved skate baton apparatus to permit enhanced ease of transport along an underlying skating surface.

2. Description of the Prior Art

Various manipulation pole structure such as ski poles indicated in U.S. Pat. Nos. 4,775,168; 4,620,723; and 4,955,969 as examples are indicated in the prior art to permit projecting of individuals along an underlying surface, wherein the instant invention attempts to overcome deficiencies of the prior art by providing for a break-down baton structure arranged for ease of assembly and disassembly to provide for a plurality of batons having telescoping friction tips and in this respect, the present invention substantially fulfills this need.

SUMMARY Of THE INVENTION

In view of the foregoing disadvantages inherent in the known types of baton apparatus now present in the prior art, the present invention provides a skate baton apparatus wherein the same is arranged to employ a plurality of separable housings, each including telescoping rod structure to permit ease of projection along an underlying support surface for a skating procedure. As such, the general purpose of the present invention, which will be described subsequently in greater detail, is to provide a new and improved skate baton apparatus which has all the advantages of the prior art baton apparatus and none of the disadvantages.

To attain this, the present invention provides a baton structure having first and second cylindrical housings arranged for securement relative to one another, wherein each of the first and second housings include housing tubes and rods arranged for telescoping extension and locking relative to each of the housings, with each of the rods having a resilient tip for use as a friction tip to promote displacement along a skating surface by an individual. The first housing includes a reflective mirror structure for viewing traffic conditions rearwardly of an individual, with the second housing having a fluid dispenser to dispense a defensive fluid such as (MACE) therefrom.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved skate baton apparatus which has all the advantages of the prior art baton apparatus and none of the disadvantages.

It is another object of the present invention to provide a new and improved skate baton apparatus which may be easily and efficiently manufactured and marketed.

It is a further object of the present invention to provide a new and improved skate baton apparatus which is of a durable and reliable construction.

An even further object of the present invention is to provide a new and improved skate baton apparatus which is susceptible of a low cost of manufacture with regard to both materials and labor, and which accordingly is then susceptible of low prices of sale to the consuming public, thereby making such skate baton apparatus economically available to the buying public.

Still yet another object of the present invention is to provide a new and improved skate baton apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 8 is an isometric illustration of a second housing end cap.

FIG. 9 is an orthographic view, taken along the lines 9—9 of FIG. 8 in the direction indicated by the arrows.

FIG. 10 is an isometric illustration of a first housing end cap.

FIG. 11 is an orthographic view, taken along the lines 11—11 of FIG. 10 in the direction indicated by the arrows.

DESCRIPTION OF THE PREFERRED EMBODIMENT

Figure 1:
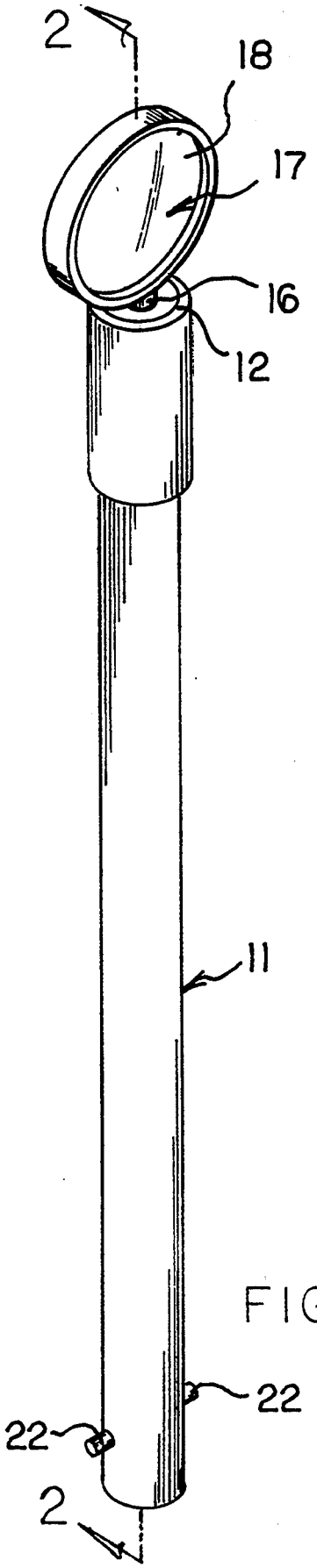
FIG. 1 is an isometric illustration of the first housing structure of the invention.
Figure 2:
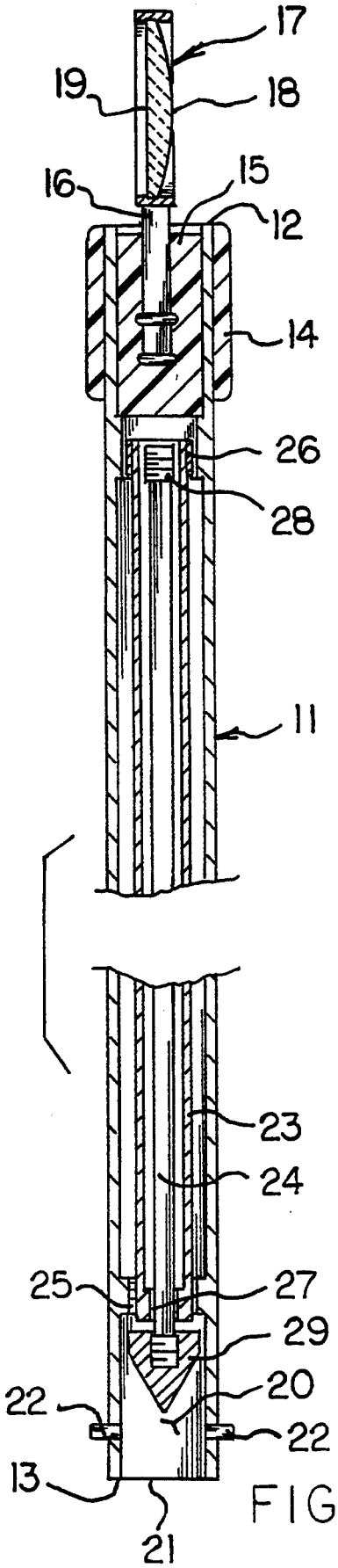
FIG. 2 is an orthographic view, taken along the lines 2—2 of FIG. 1 in the direction indicated by the arrows.

With reference now to the drawings, and in particular to FIGS. 1 to 11 thereof, a new and improved skate baton apparatus embodying the principles and concepts of the present invention and generally designated by the reference numeral 10 will be described.

Figure 3:
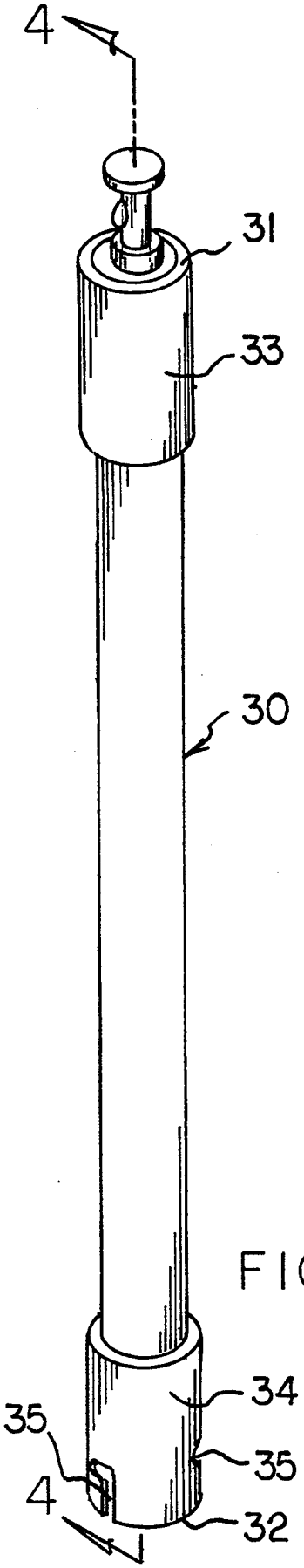
FIG. 3 is an isometric illustration of the second housing structure.
Figure 4:
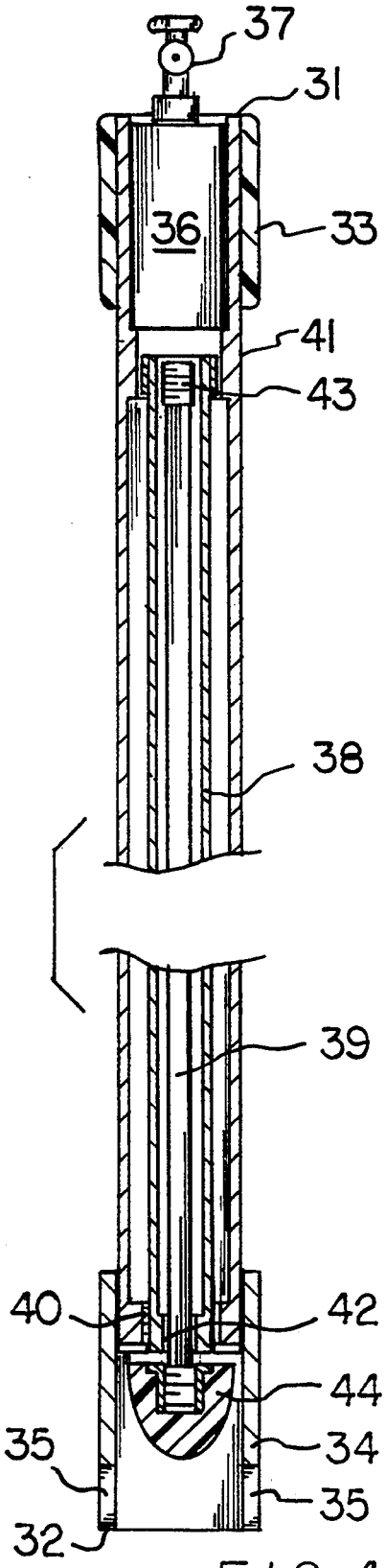
FIG. 4 is an orthographic view, taken along the lines 4—4 of FIG. 3 in the direction indicated by the arrows.
Figures 5, 5A, 5B, 6, 7:
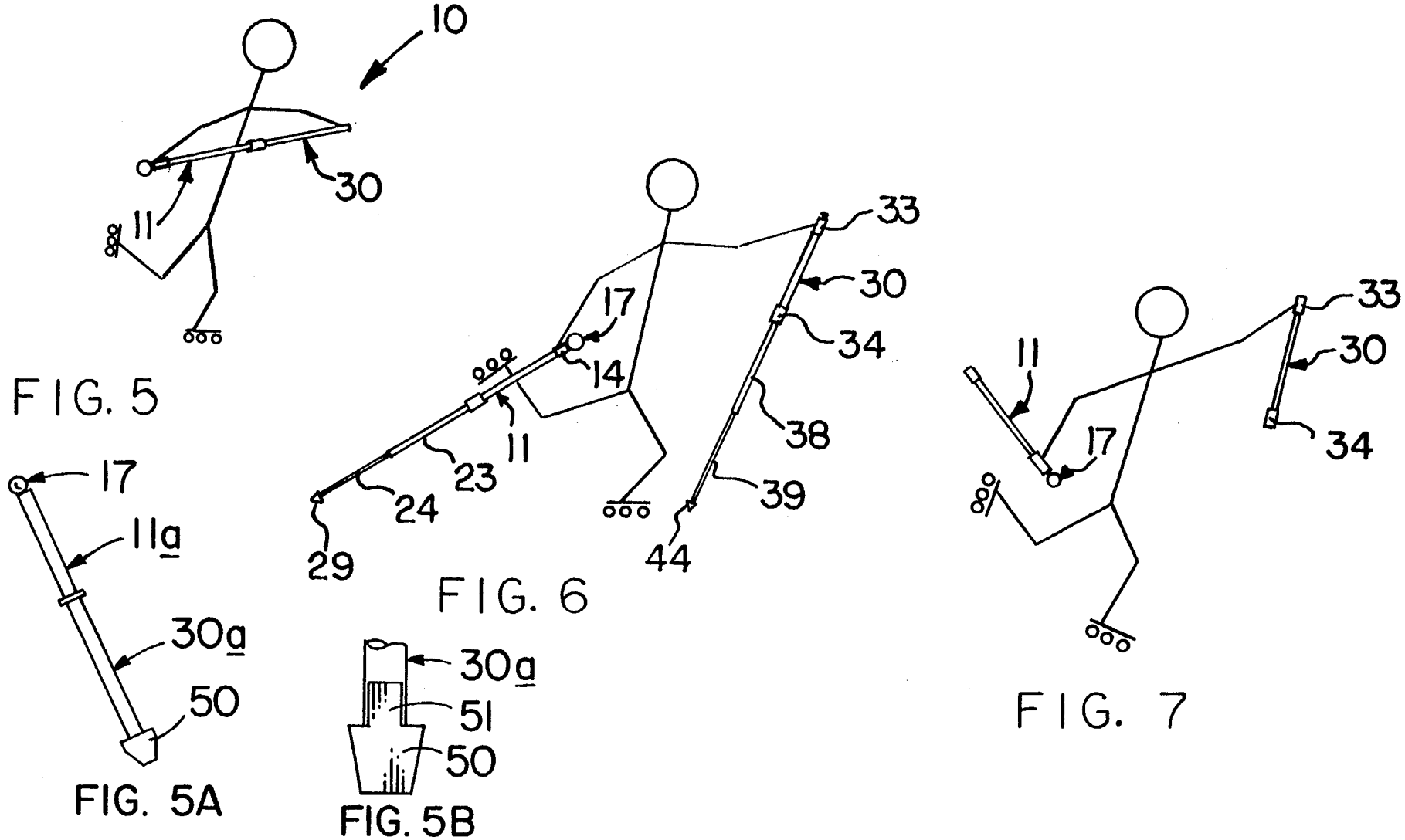
FIG. 5, FIG. 6, and FIG. 7 are diagrammatic illustrations of the baton apparatus in use.
FIG. 5*a* is an orthographic view of a further baton structure of the organization, wherein a housing of tubular construction secured to the first housing, with the second housing having a resilient bumper of truncated conical configuration received therewithin.
FIG. 5*b* is an orthographic view of the lowermost end of the second housing as indicated in FIG. 5*a*, and the truncated conical bumper positioned therewithin.

More specifically, the skate baton apparatus 10 of the instant invention essentially comprises a first cylindrical housing 11 arranged for securement to a second cylindrical housing 30, in a manner as indicated in FIG. 5. The first housing 11 includes a first housing first end 12 spaced from a first housing second end 13. A first housing resilient sleeve 14 is mounted exteriorly of the first housing 11 extending from the first end 12. A first housing resilient core 15 is directed into the first housing extending from the first end 12. A support shaft 16 coaxially aligned with the housing 11 projects beyond the first housing first end 12 terminating in a mirror 17 having a convex mirror surface 18 and a planar mirror surface 19 for use by an individual in viewing of traffic rearwardly in use of the organization. A first housing cavity 20 extends from the resilient core 15 to the first housing second end 13, with a first housing entrance opening 21 positioned for access to the first housing cavity 20 through the first housing second end 13. A plurality of lock rods 22 are orthogonally oriented relative to the axis of the first housing and positioned in adjacency relative to the first housing second end 13 for locking association with a second housing rigid clamp sleeve 34, as illustrated in FIG. 3. The first housing within the first housing cavity 20 includes a first housing outer tube 23, having a first housing pole 24 received within the first housing tube 23. The first housing outer tube 23 and the first housing pole 24 are arranged for sliding reception within the first housing cavity 20 and are slid in the first housing for extension relative to the first housing. The first housing includes a first housing internally threaded bore 25 positioned in adjacency relative to the first housing second end 13 securable to an outer tube externally threaded first end 26. The outer tube 23 includes an outer tube internally threaded second end bore 27 to threadedly engage the first housing pole first housing pole externally threaded first end 28. The first housing pole 24 includes a first housing pole resilient conical push pad 29 mounted at the first housing pole second end for use of the organization as a push rod when the first housing 11, the first housing tube 23, and the first housing pole 24 are arranged in an extended locked configuration relative to one another, as indicated in FIG. 6. The second housing 30 includes a second housing first end 31 spaced from a second housing second end 32, with a second housing resilient sleeve 33 mounted to the second housing at the second housing first end exteriorly of the housing, with the second housing second end having a second housing resilient clamp sleeve 34, including L-shaped slots 35 to receive and secure the lock rods 22. A gas cylinder 36 is positioned within the second housing projecting into the second housing from the second housing first end 31. The gas cylinder 36 includes a nozzle 37 to permit manual projection of gas within the gas cylinder 36. Such gas is typically of a defensive type composition, such as (MACE) as an example.

The second housing 30 includes second housing outer tube 38 positioned within the second housing, and a second housing pole 39 positioned within the second housing outer tube 38. The second housing includes a second housing internally threaded bore 40 positioned in adjacency relative to the second housing rigid clamp sleeve 34 to threadedly engage a second housing outer tube externally threaded first end 41. The second housing outer tube includes a second housing outer tube internally threaded bore 43 at first end of the second housing tube 38 to threadedly engage a second housing pole externally threaded first end 43. A second housing pole resilient bumper tip 44 is mounted to a second end of the second housing pole 39, as indicated in FIG. 6, for use as a push rod for projecting an individual along in a skating procedure relative to an underlying surface.

The FIGS. 8 and 9 indicate a first housing cap 45 having first housing cap L-shaped slots for securement to the first housing first end 13. Similarly, a second housing cap 46 having second housing cap projections are arranged for projection within the second housing rigid clamp sleeve slots 35. In this manner, the first and second housings are arranged in separation relative to one another to contain the respective housings outer tubes and poles within the respective housings. It should be understood that when the housings are secured together, in a manner as indicated in FIG. 5, that the confronting of the first housing pole resilient conical push pad 29 relative to the second housing pole resilient bumper tip 44 maintain components within each respective housing in a secured relationship therewithin.

The FIGS. 5*a* and 5*b* indicate the use of a modified second housing 30*a*, having a resilient bumper mounted within the free distal end of the second housing. The bumper 50 is of a typically truncated conical configuration, having shaft member 51 coaxially and integrally mounted to the bumper 50 received within the modified second housing 30*a*. The shaft 51 may be secured within the second housing 30*a* utilizing mechanical fasteners or available adhesives as required.

The use of the organization of FIG. 5*a* and 5*b* permit the bumper member 50 to be dragged behind an individual employing the structure as a braking or slowing medium permitting a skater to address steeper grades under greater control. Typically, the bumper 50 is formed of a hard-like rubber material to accommodate enhanced usage and wear when dragged behind an individual employing the pole-like structure. Further, the truncated conical configuration, as indicated in FIG. 5*b*, permits greater surface contact with a support roadway and the like to permit pressure being applied to the curvilinear surface of the bumper wherein such dragging of the bumper will permit slowing of the skater to any desired level of speed.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A skate baton apparatus, comprising, a first cylindrical housing and a second cylindrical housing, the first cylindrical housing having a first housing first end spaced from a first housing second end, the second cylindrical housing including a second housing first end and a second housing second end, the first housing first end including a first housing resilient sleeve mounted about the housing extending from the first housing first end, the second housing having a second housing resilient sleeve extending from the second housing first end, and the second housing second end including a clamp sleeve having a plurality of L-shaped slots directed through the clamp sleeve adjacent the second housing second end, and the first housing having a plurality of lock rods projecting radially of the first housing adjacent the first housing second end, with the lock rods arranged for reception within the slots.

2. An apparatus as set forth in claim 1 wherein the first housing first end further includes a resilient core mounted within the first housing extending into the first housing from the first housing first end, and the core including a support shaft, the support shaft projecting beyond the first housing first end and including a mirror, the mirror having a convex mirror surface and a planar mirror surface, and the second housing first end including a gas cylinder directed into the second housing from the second housing first end, the gas cylinder including a gas cylinder nozzle projecting exteriorly of the second housing first end to permit manual relationship of the nozzle.

3. An apparatus as set forth in claim 2 wherein the first housing includes a first housing cavity, and a first housing outer tube directed into the first housing cavity, and the first housing outer tube slidably receiving the first housing pole, and the first housing including a first housing internally threaded bore positioned in adjacency to the first housing second end, and the first housing outer tube including an outer tube externally threaded first end arranged for threaded reception within the first housing internally threaded bore, the outer tube having an outer tube internally threaded second end bore, with the first housing pole including a first housing pole externally threaded first end securable to the outer tube internally threaded second end bore, and the first housing pole further including a first housing pole resilient conical push pad mounted to the first housing pole second end.

4. An apparatus as set forth in claim 3 wherein the second cylindrical housing includes a second housing outer tube slidably received within the second housing, and a second housing pole slidably received within the second housing outer tube, and the second housing including a second housing internally threaded bore within the second housing adjacent the second housing second end, with the second housing outer tube including a second housing outer tube externally threaded first end arranged for threaded engagement with the second housing internally threaded bore, the second housing tube including a second housing outer tube internally threaded bore positioned in adjacency to the second housing second end, and the second housing outer tube including a second housing outer tube externally threaded first end arranged for reception within the second housing internally threaded bore, and the second housing outer tube including a second housing outer tube internally threaded bore at a second housing outer tube second end, with the second housing pole including a second housing pole externally threaded first end arranged for threaded engagement within the second housing outer tube internally threaded bore, and the second housing pole including a second housing pole resilient bumper tip mounted to a second housing pole second end.

5. An apparatus as set forth in claim 4 including a first housing cap, the first housing cap including a plurality of cap slots arranged for engagement with the lock rods, the second housing including a second housing cap, the second housing cap including a plurality of second housing cap lock rods, wherein the second housing cap lock rods are arranged for reception within the second housing slots.

* * * * *